United States Patent [19]

Ferguson

[11] Patent Number: 4,610,637

[45] Date of Patent: Sep. 9, 1986

[54] TOY VEHICLE HAVING ROTATING ELEMENT

[75] Inventor: Edward Ferguson, Torrance, Calif.

[73] Assignee: Tomy Kogyo Co. Inc., Tokyo, Japan

[21] Appl. No.: 720,995

[22] Filed: Apr. 8, 1985

[51] Int. Cl.[4] ..... A63H 17/00

[52] U.S. Cl. ..... 446/237; 446/411; 446/427; 446/451; 434/259

[58] Field of Search ..... 446/237, 238, 272, 280, 446/281–288, 448, 449, 451, 408–410, 419, 427; 280/207, 289 D; 434/259

[56] References Cited

U.S. PATENT DOCUMENTS

| | | | |
|---|---|---|---|
| 237,897 | 2/1881 | Pfanne | 446/287 |
| 1,104,574 | 7/1914 | Sundquist | 446/238 |
| 1,931,139 | 10/1933 | Warren | 446/451 |
| 2,383,232 | 8/1945 | Ayres | 446/451 |
| 2,747,297 | 5/1956 | Zalkind | 446/419 X |
| 3,421,252 | 1/1969 | Downey | 446/427 |
| 3,763,734 | 10/1973 | Meyer et al. | 446/410 X |
| 4,195,421 | 4/1980 | Tucker | 434/259 |

FOREIGN PATENT DOCUMENTS

| | | | |
|---|---|---|---|
| 289406 | 7/1953 | Switzerland | 446/410 |

*Primary Examiner*—F. Barry Shay

*Attorney, Agent, or Firm*—K. H. Boswell

[57] ABSTRACT

A toy vehicle has a body having left and right side walls and an arcuate wall extending from front to rear located inbetween the left and right side walls. The body is supported by wheels, a portion of each of the wheels extending upwardly through an opening formed wherein the side walls join the arcuate wall. A cylindrical element is positioned on the vehicle over the arcuate wall between the left and the right side walls so as to rest on the portions of the wheels which extend upwardly through the openings in the arcuate wall. As the vehicle is rolled on a surface, rotation of the wheels of the vehicle is transferred to the cylindrical element to rotate the same on the body of the vehicle. The cylindrical element has a plurality of openings shaped so as to receive a like plurality of blocks. The blocks can be placed within the cylindrical element by inserting them through the appropriate openings. The cylindrical element can be removed from the vehicle and utilized as a separate component in conjunction with the blocks.

4 Claims, 3 Drawing Figures

TOY VEHICLE HAVING ROTATING ELEMENT

BACKGROUND OF INVENTION

This invention is directed to a child's toy vehicle wherein movement of the vehicle across a support surface is transferred to a member carried by the vehicle so as to rotate the member on the vehicle.

A large variety of toy vehicles are known. Generally, for the preschool age child, these are limited to simply push and pull vehicles which the child can move across a support surface by appropriately pushing or pulling.

In order to enhance these preschool type vehicle toys, cams and/or crank disks have been connected to the wheels and utilized to move an auxiliary portion of the toy in response to movement of the toy across a support surface. The use of such cranks or cams, however, generally entails fixing the auxiliary portion of the toy to the main body of the vehicle, thus inhibiting the child's natural explorative instincts in separating one portion of the toy from a further portion of the toy and recombining the same.

BRIEF DESCRIPTION OF THE INVENTION

In view of the above, it is a broad object of this invention to provide a toy vehicle which utilizes a method of transferring motion between component parts of the vehicle which requires no auxiliary cams, cranks, or the like. It is a further object of this invention to provide a toy vehicle which includes an auxiliary part thereof which is capable of moving with respect to the main part of the vehicle as the vehicle is moved across a support surface. Additionally, it is an object of this invention to provide a toy which because of its design and engineering principles is capable of economic manufacturing and, thus, is economically available to the consuming public, yet still employs those engineering principles which result in a long and useful service life of the toy, yet at the same time result in a toy which is both interesting and stimulating to the child.

These and other objects, as will become evident by the remainder of this specification, are achieved in a toy which comprises: a vehicle body; said vehicle body including left and right side walls and at least one further wall extending between said side walls, together said side walls and said further wall forming an upwardly opening cavity in said body; at least two wheels rotatably mounted on said body in association with said further wall with at least a portion of each of said wheels extending below said body to rotatably support said body on a support surface; said further body wall including at least two openings located therein, said openings positioned in said further wall in locations aligned over said wheels whereby a portion of each of said wheels extends upwardly through the respective opening with which it is associated; an element, said element formed as a surface of rotation; said element sized and shaped so as to at least partially fit within said cavity with said surface of rotation of said element resting on said portion of said wheels which extend upwardly through said opening in said further wall whereby as said wheels rotate in conjunction with movement of said vehicle body across said support surface, said rotation of said wheels is transferred to said surface of rotation of said element to rotate said element within said cavity.

In the preferred embodiment of the toy, the auxiliary element is formed as a cylinder having a cylindrical surface of rotation and top and bottom walls. In the preferred embodiment one or more openings can be provided for egress and ingress to the interior of the cylinder. Preferably one of these is formed in the top wall and others are formed in the cylindrical surface of rotation. These can be formed as geometric shapes allowing for the insertion and withdrawal of corresponding geometrically shaped objects into and out of the auxiliary element.

Further, in the preferred embodiment of the toy, the toy vehicle is equipped with four wheels with each of them extending upwardly through an opening of the further wall of the toy whereby the auxiliary element is supported on at least a portion of all four of the wheels to provide for ease of rotation of the auxiliary element within the cavity of the vehicle body.

In the illustrative embodiment the further wall is formed as an arcuate wall extending between the left and right side walls from the front of the vehicle body to the back of the vehicle body. The arcuate wall provides for an appropriate shaped cavity so as to receive the cylindrical shaped auxiliary element and allow it to rest on and be rotated by the totality of the wheels attached to the toy vehicle body.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the toy arts will realize that these principles and/or concepts are capable of being utilized in a variety of embodiments which may differ from the embodiment utilized to illustrate the invention. For this reason, this invention is not to be construed as being solely limited to the illustrative embodiment, but should only be construed in view of the claims.

DETAILED DESCRIPTION OF THE INVENTION

Figure 1:
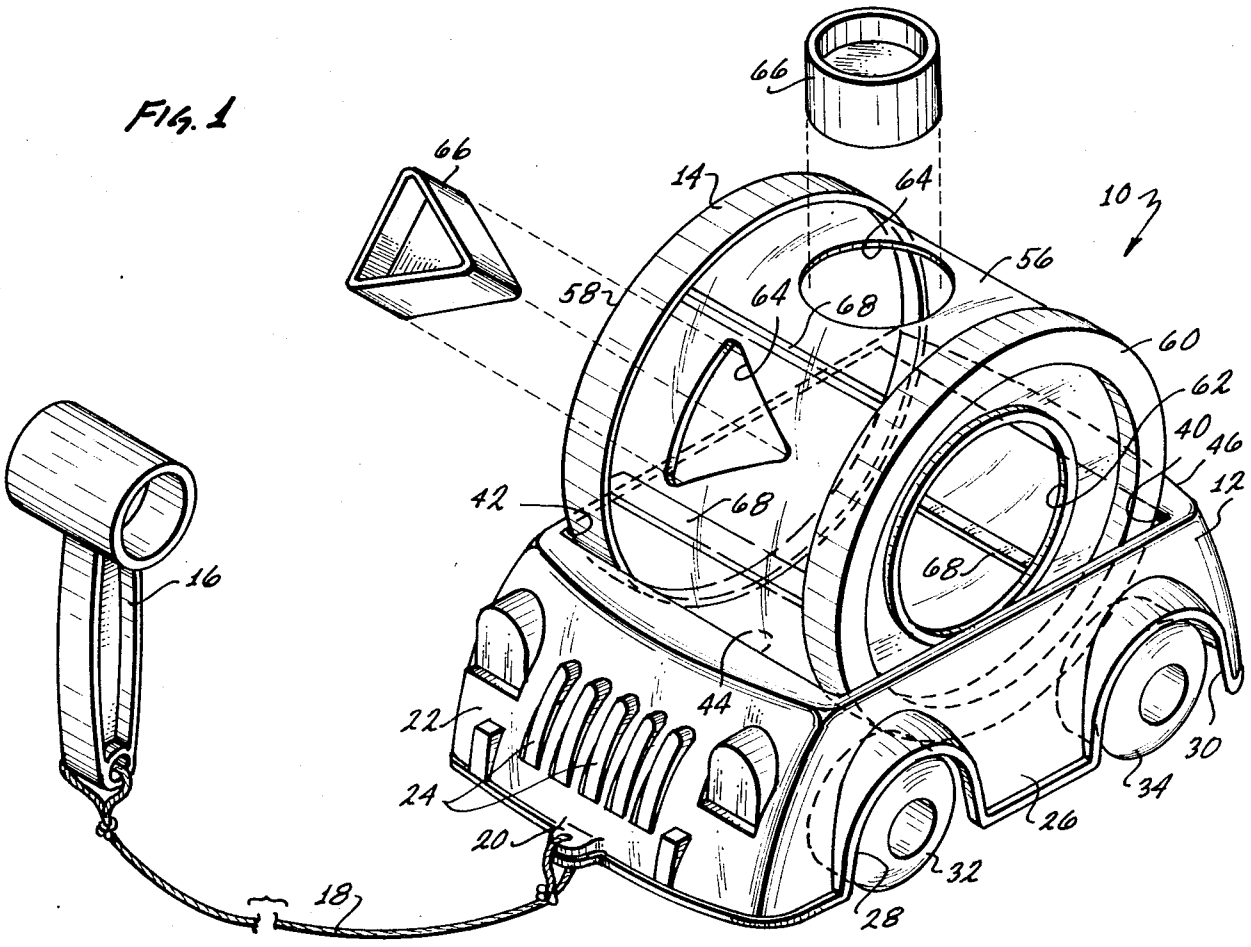
FIG. 1 is an isometric view of a toy vehicle of the invention with certain auxiliary parts exploded away for clarity of operation of the invention.

A toy 10 illustrative of this invention is shown in FIG. 1. It has several component parts. These include a vehicle body 12 which can receive and support a removable cylinder 14. A handle 16 is attached via a cord 18 to an attaching ear 20 which projects out of front surface 22 of the body 12. Also located on the front surface 22 are a variety of raised sections collectively identified by the numeral 24 giving the body 12 a somewhat automobile appearance.

As is seen in FIG. 1, the left side of the vehicle 12 includes an outside panel 26 having a front wheel cutout 28 and a rear wheel cutout 30. Exposed through these wheel cutouts 28 and 30 are left front wheel 32 and left rear wheel 34. The right side of the vehicle body 12 is formed in the same manner and includes right front wheel 36 and right rear wheel 38.

The front wheels 32 and 36 are mounted about a common axle which is supported on the underneath side of the vehicular body 12. Likewise, the rear wheels 34 and 38 are also appropriately mounted to the vehicular body 12. The wheels 32, 34, 36, and 38 are free to rotate on the vehicular body 12 such that the toy 10 can be pulled or pushed across an appropriate support surface.

Each of the left and right side of the vehicular body 12 also include an interior panel 40 on the left hand side and an interior panel 42 on the right hand side. An arcuate shaped wall 44 extends between the right and left interior panels 40 and 42 from the front surface 22 to the rear surface 46. Together the wall 44 and the interior panels 40 and 42 form an upwardly opening cavity within the vehicular body 12.

Figure 2:
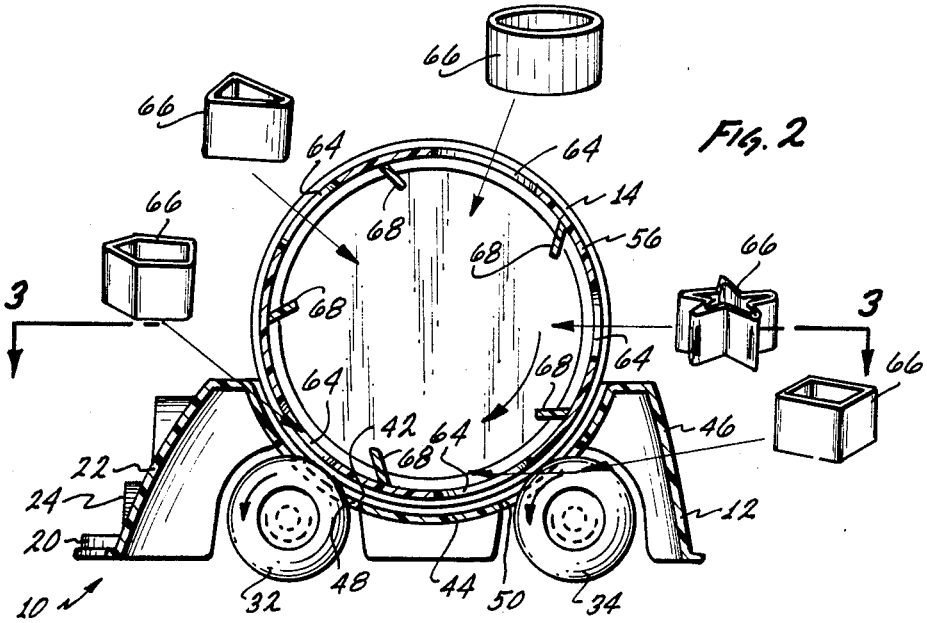
FIG. 2 is a side elevational view in section of the vehicle portion of the toy of FIG. 1.
Figure 3:
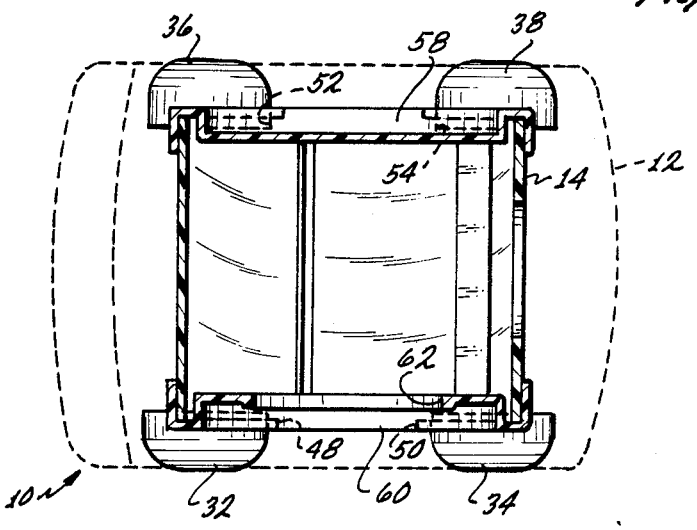
FIG. 3 is a sectional view about the line 3—3 of FIG. 2.

The wall 44 is positioned in association with each of the wheels 32, 34, 36, and 38. There is an appropriate opening wherein the wall 44 joins the interior panels 40 and 42 over the respective front and rear wheels such that a portion of each of the wheels 32, 34, 36, and 38 extend upwardly through these openings within the cavity defined by the wall 44 and the panels 40 and 42. As seen in FIG. 2, the opening 48 allows for protrusion of the wheel 32 into the forward part of the cavity, and the opening 50 allows for protrusion of the wheel 34 into the rearward portion of the cavity. Similar openings 52 and 54 are formed on the left side of the vehicular body 12.

When the removable cylinder 14 is positioned within the cavity on the vehicular body 12, it fits between the interior panels 40 and 42 and above the wall 44 such that it rests on a portion of each of the wheels 32, 34, 36, and 38 which extend upwardly through the openings 48, 50, 52, and 54 within the cavity. In this way, the removable cylinder 14 is fully supported by the wheels 32, 34, 36, and 38. Since it doesn't contact any other surface, it is rotated in conjunction with rotation of the respective wheels. Thus, when the toy 10 is pulled forward and the wheels, as seen in FIG. 2, rotate counterclockwise, this rotates the movable cylinder 14 clockwise. If the toy is pushed in the opposite direction, the wheels will rotate clockwise and the cylinder will rotate conunterclockwise.

When the removable cylinder 14 is positioned within the cavity on the body 12, its connection with and support by the tops of the wheels 32, 34, 36, and 38 is hidden from view, and as such its rotation on the body 12 produces a very interesting visual effect.

By pushing or pulling the vehicular body 12, the removable cylinder 14 is caused to rotate therein. However, if, in fact, the cylinder is rotated by the child, this rotation is transferred to the wheels 32, 34, 36, and 38, which, in turn, cause movement of the vehicular body 12 across a support surface. This leads to further play value of the toy 10 upon discovery of this feature by an enterprising and inquisitive child.

The removable cylinder 14 includes a cylinder surface of rotation 56 formed of a transparent material which is joined to a bottom wall 58 and a top wall 60. The bottom wall 58 is solid and the top wall 60 includes a central opening 62. Positioned around the periphery of the cylindrical surface 56 are a plurality of openings collectively identified by the numeral 64. The openings 64 each have a different geometrical shape allowing for isertion of an appropriate block collectively identified by the numeral 66 into the opening bearing the same shape as the block. Thus, the round block shown in the 12 o'clock position in FIG. 1 can be inserted through the round opening 64, whereas the triangular block shown in the 11 o'clock position can be inserted into the triangular opening 64. Any of the blocks, however, can be inserted into or taken out of the interior of the cylinder 14 through the larger opening 62 in the top wall 60.

Positioned within the interior of the removable cylinder 14 are a plurality of baffles collectively identified by the numeral 68. The baffles 68 are integrally formed with and project from the interior of the cylindrical wall 56. When one or more of the blocks 66 is located within the interior of the removable cylinder 14 and the toy 10 is moved along a support surface, rotation of the removable cylinder 14 by the wheels 32, 34, 36, and 38 results in engagement of the block 66 by the baffles 68 to lift them and then drop them within the interior of the cylinder 14, further adding to the play value and enjoyment of the toy 10.

The cylinder 14 can be removed from the body 12 and the child can utilize it alone or in conjunction with the blocks 66 in playing with these components as a separate item. The geometric shapes of the opening 64 and the block 66 help the child achieve hand/eye coordination.

I claim:

1. A toy which comprises:

a vehicle body;

said vehicle body including left and right side walls and a further wall, said further wall being arcuate in shape and extending between said left and right side walls from front to back on said vehicle body, together said side walls and said further wall forming an upwardly opening cavity in said body;

four wheels located in first and second sets, said wheels being rotatably mounted on said body in association with said further wall with at least a portion of each of said wheels extending below said body to support said body as said wheels rotate on a support surface;

said further wall including four openings located therein, said respective openings in said further wall extending into the left and right side walls adjacent to said further wall, said openings positioned in said further wall and said side walls, in locations aligned over said wheels whereby a portion of each of said wheels extends upwardly through the respective opening with which it is associated partly through said further wall and partly through one of said left and right side walls;

an element, said element formed as a surface of rotation;

said element sized and shaped so as to partially fit within said cavity with its axis of rotation parallel to those of said wheels and with said surface of rotation of said element resting on said portions of said wheels which extend upwardly through said openings in said further wall and said side walls whereby as said wheels rotate in conjunction with movement of said vehicle body across said support surface, said rotation of said wheels is transferred to said surface of rotation of said element to rotate said element within said cavity.

2. The toy of claim 1 wherein:

said element is cylindrically shaped and sized so as to fit into said cavity on said vehicle body with the top and bottom surfaces of said cylinder positioned in association with said right and said left side walls respectively of said body and said cylindrical surface of said cylinder positioned in association with said further wall of said body.

3. The toy of claim 2 wherein:

said cylinder includes at least one opening therein, said opening sized and shaped so as to receive at least one external body within the interior of said cylinder.

4. The toy of claim 3 wherein:

said cylinder includes a plurality of openings, at least one of said openings formed in one of the top and bottom surfaces of said cylinder and at least a further of said openings formed in the cylindrical surface of rotation of said cylinder.

* * * * *